US008870628B2

(12) United States Patent
Schäfer et al.

(10) Patent No.: US 8,870,628 B2
(45) Date of Patent: Oct. 28, 2014

(54) DEVICE FOR CLAMPING AN OPTICAL WORKPIECE, PARTICULARLY SPECTACLE LENS, BLOCKED ON A BLOCK PIECE FOR PROCESSING AND/OR COATING THEREOF

(75) Inventors: Holger Schäfer, Weilmünster (DE); Herbert Wagner, Lahnau (DE); Edward McPherson, Asslar (DE); Marc Savoie, Wetzlar (DE)

(73) Assignee: Satisloh AG, Baar (CH)

( * ) Notice: Subject to any disclaimer, the term of this patent is extended or adjusted under 35 U.S.C. 154(b) by 715 days.

(21) Appl. No.: 13/124,724

(22) PCT Filed: Oct. 13, 2009

(86) PCT No.: PCT/EP2009/007332

§ 371 (c)(1),
(2), (4) Date: May 25, 2011

(87) PCT Pub. No.: WO2010/043365

PCT Pub. Date: Apr. 22, 2010

(65) Prior Publication Data

US 2011/0220018 A1 Sep. 15, 2011

(30) Foreign Application Priority Data

Oct. 17, 2008 (DE) ..... 10 2008 051 833

(51) Int. Cl.
*B24B 13/005* (2006.01)

(52) U.S. Cl.
CPC ..... *B24B 13/005* (2013.01)
USPC ..... 451/379; 451/384; 451/385; 451/390

(58) Field of Classification Search
CPC ..... B24B 13/005
USPC ..... 451/379, 384, 385, 390
See application file for complete search history.

(56) References Cited

U.S. PATENT DOCUMENTS

| | | | | | |
|---|---|---|---|---|---|
| 2,428,375 | A | * | 10/1947 | Massierer | 451/384 |
| 2,441,472 | A | * | 5/1948 | D Avaucourt | 451/384 |
| 2,573,668 | A | * | 10/1951 | McCar et al. | 451/460 |
| 4,277,916 | A | * | 7/1981 | Buhler | 451/384 |
| 4,562,671 | A | | 1/1986 | Bouillon et al. | |

(Continued)

OTHER PUBLICATIONS

Entwurf—Optikfertigung—Spannmittel für die Optik—Teil 5: Spannzangen zur Spannung der Blockstücke in der Brillenglasfertigung, DIN 58739-5, Nov. 2007, 6 pages.

*Primary Examiner* — Maurina Rachuba
(74) *Attorney, Agent, or Firm* — Reising Ethington P.C.

(57) ABSTRACT

The invention discloses a device (10) for clamping particularly an eye glass lens blocked on a block piece for processing and/or coating said eye glass lens, comprising a receiving space (34) having a center line (M) for a clamping section of the block piece, and a plurality of clamping surfaces (36) provided in a boundary region of the receiving space, which may optionally be engaged in the clamping section of the block piece in order to clamp the block piece. In order to avoid excessive deformation of the clamped block piece, the clamping surfaces are positioned opposite of each other in pairs at a radial distance to the center line and can be displaced optionally toward or away from each other by a clamping piece (38) in order to clamp the clamping section of the block piece by way of clamping forces (F), which are substantially oriented in a tangential direction at a radial distance to the center line, or in order to release the block piece.

23 Claims, 11 Drawing Sheets

(56) References Cited

U.S. PATENT DOCUMENTS 5,284,348 A 2/1994 Tanaka et al.
5,520,078 A * 5/1996 Hattori et al. ..... 82/165
5,567,198 A * 10/1996 Cook ..... 451/384
5,746,436 A * 5/1998 Kulan et al. ..... 451/384
5,785,580 A * 7/1998 Cook ..... 451/42
2011/0033615 A1 2/2011 Breme et al.
2011/0067628 A1 * 3/2011 Savoie et al. ..... 118/500
2011/0220018 A1 * 9/2011 Schafer et al. ..... 118/503

* cited by examiner

DEVICE FOR CLAMPING AN OPTICAL WORKPIECE, PARTICULARLY SPECTACLE LENS, BLOCKED ON A BLOCK PIECE FOR PROCESSING AND/OR COATING THEREOF

TECHNICAL FIELD

The present invention relates generally to a device for clamping an optical workpiece, which is blocked on a block piece, for processing and/or coating thereof, which device serves the purpose of mounting the blocked workpiece in the respective processing machine and/or coating facility.

In particular, the invention relates to a device for clamping blocked spectacle lenses, which are to be clamped en masse in so-termed 'RX workshops' in the respective processing machine or coating facility, before the respective blocked spectacle lens is processed at its rear or front surface with respect to its optical effect and/or at the edge for fitting in an associated spectacles frame by geometrically defined (milling/turning) or geometrically undefined (grinding/polishing) machining and/or is coated on its rear or front surface for achieving additional effects (increase in scratch resistance, anti-reflection characteristics, metallizing, hydrophobic characteristics, etc.).

BACKGROUND OF THE DISCLOSURE

Various clamping devices are currently in use in spectacle lens prescription production ('RX workshops'), such as shown in, for example, German Standard DIN 58739-5 'Optical production—Clamping means for optics—Part 5: Clamping chucks for clamping block pieces in spectacle lens production', which defines the category. A characterizing feature of the previously known clamping chucks is that they fix the block piece at a diameter, which is intended therefor, by forces acting in radial direction, i.e. in the direction of the center axis of the block piece. These forces are applied either by way of bending of a solid body joint—'version B' according to the Standard—or, however, in 'classical' manner with the help of two inclined surfaces—'Version A' according to the Standard: the clamping chuck is constructed as an internal cone which is slotted in the clamping region and which is supported at a closed, somewhat steeper outer cone of an annular clamping sleeve fixedly connected with the workpiece spindle—when the clamping chuck is drawn against a central clamping pin by a tension rod.
follows:

A problem with this prior art occurs in that, particularly when the block piece is made of a plastics material, it can be deformed as a consequence of the radially acting pressure forces applied by the clamping device, so that the block piece adopts a form differing from the form it normally has, i.e. without the action of such forces. This deformation of the block piece can be transmitted by way of the block material to the blocked spectacle lens blank so that, for example, the curve which is machined on the spectacle lens during surface processing can distort or twist when the block piece together with the spectacle lens is taken out of the clamping device and the spectacle lens is unblocked from the block piece, whereupon without external application of force it adopts its 'natural' form. This distortion/twisting of the machined, optically effective surface at the spectacle lens is regarded as critical particularly in the production of open-die surfaces, which demand very close tolerances. In addition, a very slight distortion/twisting of the curve after unblocking of the processed spectacle lens from the block piece can here remove the processed spectacle lens from the permissible tolerance range, so that it is unusable for the intended purpose, thus a reject.

In the earlier European Patent Application 08 003 335.0 of the present applicant a block piece is described which is constructed in special mode and manner in order to, inter alia, combat the above-mentioned problem. This block piece has a base body with a center axis, a workpiece fastening section at which the spectacle lens blank can be blocked by a block material, and a clamping section by way of which the block piece and thus the blocked spectacle lens blank can be held in a clamping device, wherein this block piece has the clamping section of the base body being adapted—for example by construction with three clamping projections extending in radial direction—to be clamped or held by clamping forces which are oriented substantially in a circumferential direction with respect to the center axis of the base body or substantially in a tangential direction at a spacing with respect to the center axis of the base body. As a result, clamping forces applied in circumferential direction or tangentially to the block piece cannot 'migrate' through the entire block piece, as in the conventional case in which the radial pressure forces are applied to the clamping section of the block piece, so that excessive deformations of the block piece are avoided, i.e. such deformations which are transmissible to the blocked spectacle lens blank and then could have the consequence of an undesired distortion/twisting of the finished workpiece geometry. A clamping device suitable for that purpose is not, however, described in the earlier European Patent Application 08 003 335.0.

What is desired is starting from the prior art as represented by, for example, German Standard DIN 58739-5, providing a device of simplest possible construction for clamping an optical workpiece, particularly spectacle lens, blocked on a block piece for processing and/or coating thereof, the device being constructed in such a manner that excessive deformation of the clamped workpiece and the accompanying above-mentioned problems are largely avoided.

SUMMARY OF THE DISCLOSURE

According to one aspect of the invention, a device for clamping an optical workpiece, particularly spectacle lens, blocked on a block piece for the processing and/or coating thereof, includes a receiving space, with a center axis, for a clamping section of the block piece and a plurality of clamping surfaces, which are provided in an edge region of the receiving space and which can be brought selectably into engagement with the clamping section of the block piece in order to clamp the block piece, the clamping surfaces are disposed in pairs opposite one another at a radial spacing from the center axis and are movable by a clamping member selectably towards or away from one another so as to clamp the clamping section of the block piece by clamping forces, which are oriented substantially in a circumferential direction with respect to the center axis or substantially in a tangential direction at a radial spacing from the center axis, or to release the clamping section of the block piece.

Due to the fact that the clamping surfaces of the at least one clamping surface pair are juxtaposed at a radial spacing from the center axis, which has the consequence in the case of, for example, substantially planar clamping surfaces that the surface normals of the clamping surfaces lie on a line which does not run through the center axis of the receiving space or the clamping device—as in the case of the prior art defining the category—but at a significant lateral spacing therefrom, there is avoidance, when clamping the above-described, suitably constructed block piece according to the earlier European Patent Application 08 003 335.0, in a just as simple and reliable manner that the clamping forces 'migrate' through the entire block piece and bend or otherwise deform this together with the optical workpiece blocked thereon during the processing, so that the geometry (attributable) faults at the workpiece as described in the introduction cannot arise. Rather, the clamping forces applied by a clamping surface pair are (substantially) mutually canceling or eliminating at the clamping projection, which is clamped in place therebetween, of the block piece without excessive deformation of the block piece, particularly not at its workpiece fastening section. Since all clamping surfaces of the clamping device are (relatively) movable by a clamping member selectably towards or away from one another in order to clamp or release the block piece at its clamping section without transmission of external radial forces to the block piece and workpiece, the clamping device can, moreover, be constructed in simple manner for a remotely actuated clamping or release of the block pieces, i.e. an automated actuation.

Although, in principle, even only one pair or two pairs of clamping surfaces can be provided, it is preferred with respect to good (self-)centering of the block piece and high holding forces particularly in the case of use of the clamping device in machines carrying out processing by machining if three pairs of clamping surfaces distributed over the circumference of the receiving space for the clamping section of the block piece are provided.

In a preferred embodiment of the clamping device according to the invention the clamping surface pairs are non-uniformly distributed over the circumference of the receiving space, whereby a rotational angle orientation—needed for processing geometries without rotational symmetry—of the block piece and thus of the workpiece blocked thereon about the center axis can be carried out in simple manner.

In a further preferred embodiment of the clamping device according to the invention at least one clamping surface of each clamping surface pair is provided with a profiling, which is required for high security of retention of the clamping block piece.

In principle, the clamping member can, for producing the relative movement at the clamping surface pair or pairs, be rotatable about the center axis by a rotary drive. However, with respect to a problem-free exchangeability of conventional clamping devices, i.e. a simple conversion or retrofitting of the clamping device according to the invention at existing processing machines or coating facilities, it is preferred if the clamping member is axially movable in the direction of the center axis for producing the relative movement of the clamping surfaces of each clamping surface pair, since the previously known clamping devices of existing processing machines are as a rule remotely actuated by a tension rod which is integrated in the workpiece spindle and usually spring-actuated and which opens pneumatically, so that the clamping device according to the invention can replace a conventional clamping device without a great amount of effort for conversion.

In an advantageous embodiment of the clamping device according to the invention at least one clamping surface of each clamping surface pair can additionally be formed at a base, which is preferably stationary, for example with respect to a part of the workpiece spindle of a processing machine, of the clamping device.

In a first constructional variant of the clamping device according to the invention, which in a manner that is particularly more economic and less susceptible to fault manages with only very few individual parts, the base has a plurality of resilient clamping elements which in pairs and opposite one another are each provided at the free end with a clamping surface and are disposed in operative connection with the clamping member, so that the mutually opposite clamping surfaces of each clamping element pair are movable towards one another, under resilient deformation of the clamping element, by relative movement of the clamping member with respect to the base. For this purpose, the clamping member preferably has a substantially hollow-cylindrical section, which is provided with cut-outs for reception of a respective clamping element pair, wherein the clamping member has in the region of each cut-out mutually opposite inclined surfaces which co-operate with rear inclined surfaces, which are remote from the clamping surfaces, at the clamping elements so as to resiliently deform the latter in the manner of a solid body joint in the case of relative movement between clamping member and base. With respect to a material-preserving deformation, which is resilient for as long as possible, of the clamping elements of the base it is in this regard preferred if the substantially planar inclined surfaces extend more flatly at the clamping elements of the socket with respect to the center axis—at, for example, an angle of 10°—than the substantially planar inclined surfaces in the region of the cut-outs of the clamping member—which can include an angle of, for example, 12° with the center axis—so that the clamping forces can be reliably introduced into the clamping elements by way of the clamping member 'from above or at the end'. Finally, the first constructional variant of the clamping device could, even if less preferred, in principle also be modified so that of the clamping elements of each clamping element pair at the base merely one clamping element is of resilient construction, whilst the other clamping element is fixed with respect to the base.

In a second, only slightly more complicated constructional variant of the clamping device according to the invention the base has a substantially hollow-cylindrical section which, for formation of several stationary clamping jaws each having a clamping surface, is provided, starting from an end face, with several cut-outs in which movable clamping jaws each with a respective clamping surface are received, so that—similarly to a claw clutch—each clamping surface pair has one clamping surface at a stationary clamping jaw and one clamping surface at a movable clamping jaw. In this connection, it is preferred if the movable clamping jaws are mounted in crown-like manner on an annular part, which is rotatable with respect to the base about the center axis, which in simple manner ensures a common, synchronous mobility of these clamping jaws. For simple generation of the rotational movement of the annular part the clamping member can be operatively connected with the annular part in such a manner that an axial movement of the clamping member in the direction of the center axis produces the rotational movement of the annular part about the center axis. In that case a form of operative connection is preferred in which the clamping member, which is held to be secure against rotation with respect to the base, has at least one control surface which is set at an inclination with respect to the center axis and at which a clamping pin connected with the annular part engages so as to produce the rotational movement of the annular part when the clamping member is axially moved. In order to additionally prevent, in simple manner, sluggishness or tipping of the clamping member and the annular part, control surfaces set at an inclination with respect to the center axis can be formed on sides of the clamping member which are diametrically opposite with respect to the center axis and can co-operate with associated clamping pins at the annular part. Finally, with respect to problem-free release or opening of this clamping device preferably each clamping surface pair can be urged apart by a compression spring arranged between the stationary and movable clamping jaws associated with the respective clamping surface pair.

An outer sleeve, which surrounds the clamping surface pair, can be provided particularly for protection of the mechanism of the clamping device according to the invention and also for pre-centering of the block piece in the clamping device. This outer sleeve preferably has at its free end at the inner circumferential side a substantially conically extending (pre) centering surface for the block piece. Similarly, the outer sleeve can, at its free end, have at the end face a planar annular surface for support of the block piece. Finally, provision can be made for at least one back-pressure channel, which ends by an opening at the (supporting) annular surface, to extend through the outer sleeve, so that particularly in the case of an automated processing machine the correct position of the block piece can be recognized in simple manner by way of a back-pressure sensor system.

BRIEF DESCRIPTION OF THE DRAWINGS

The invention is explained in more detail in the following by way of preferred exemplifying embodiments with reference to the accompanying, partly schematic drawings, in which the same reference numerals denote the same or corresponding parts and in which.

DETAILED DESCRIPTION OF THE EXEMPLIFYING EMBODIMENTS

Figure 3:
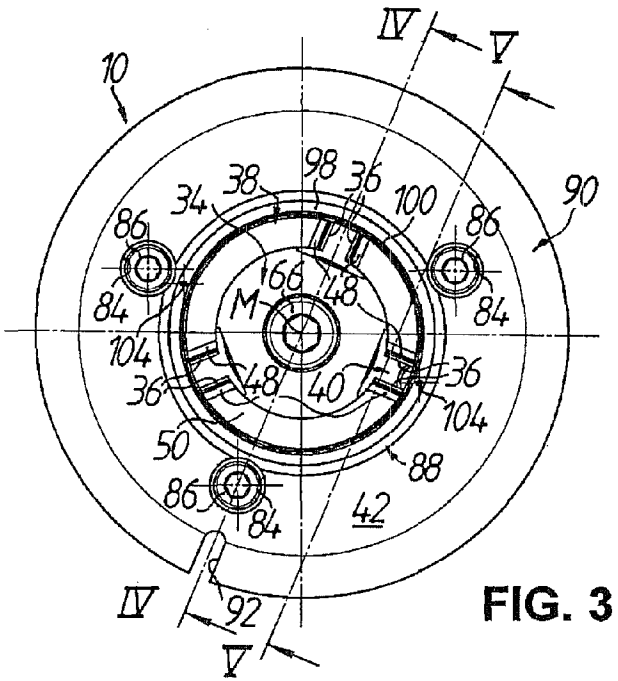
FIG. 3 shows a plan view of the clamping device according to FIG. 1.
Figure 4:
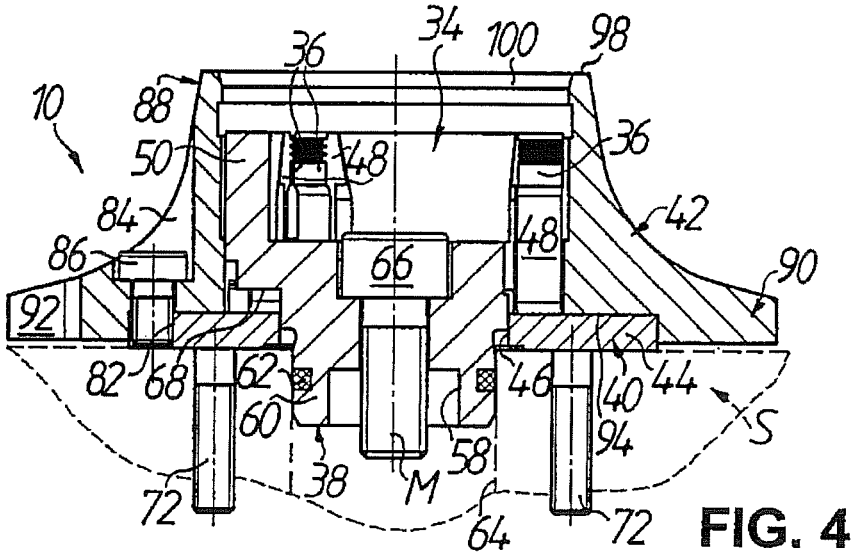
FIG. 4 shows a sectional view of the clamping device according to FIG. 1 in correspondence with the section line IV-IV in FIG. 3.
Figure 14:
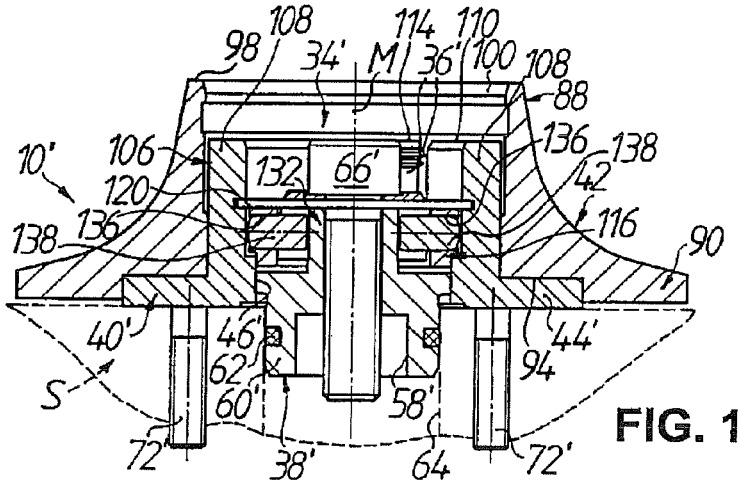
FIG. 14 shows a sectional view of the clamping device according to FIG. 13 in correspondence with the section line XIV-XIV in FIG. 13.
Figure 15:
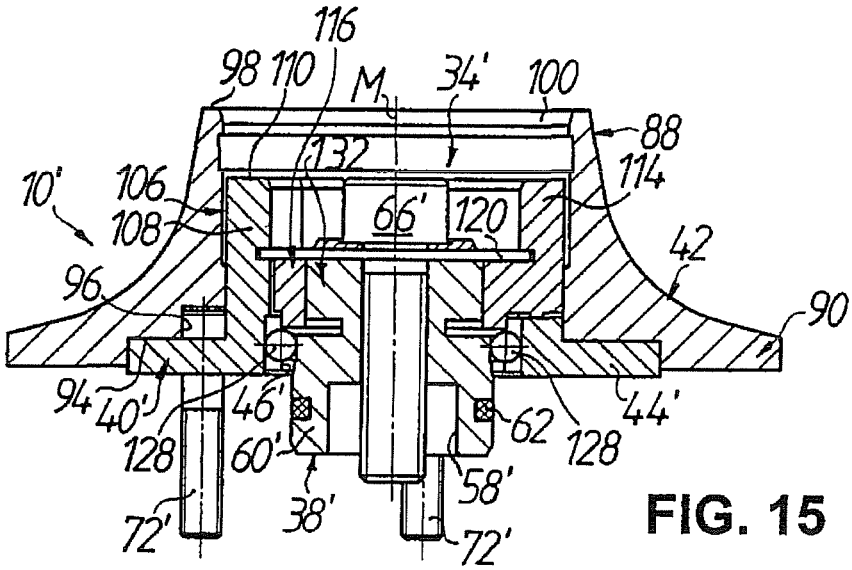
FIG. 15 shows a sectional view of the clamping device according to FIG. 13 in correspondence with the section line XV-XV in FIG. 13.
Figure 24:
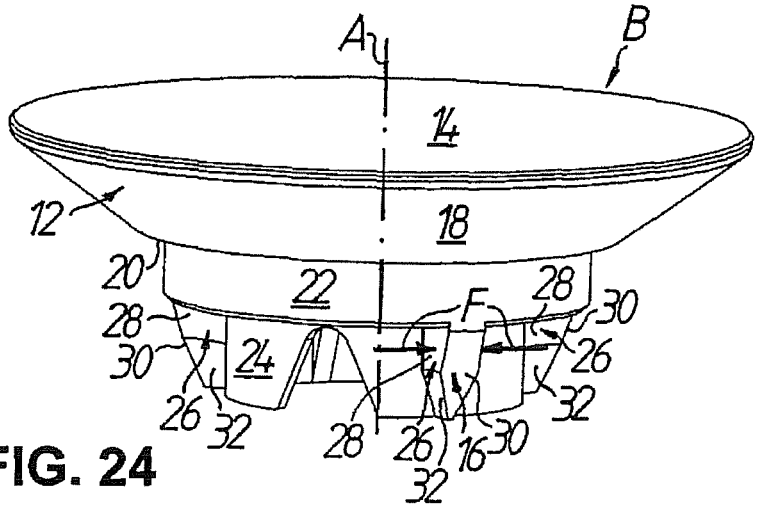
FIG. 24 shows a perspective view of a block piece, which can be clamped by the clamping devices according to the invention, in accordance with the earlier European Patent Application 08 003 335.0 of the present applicant, obliquely from above.
Figure 25:
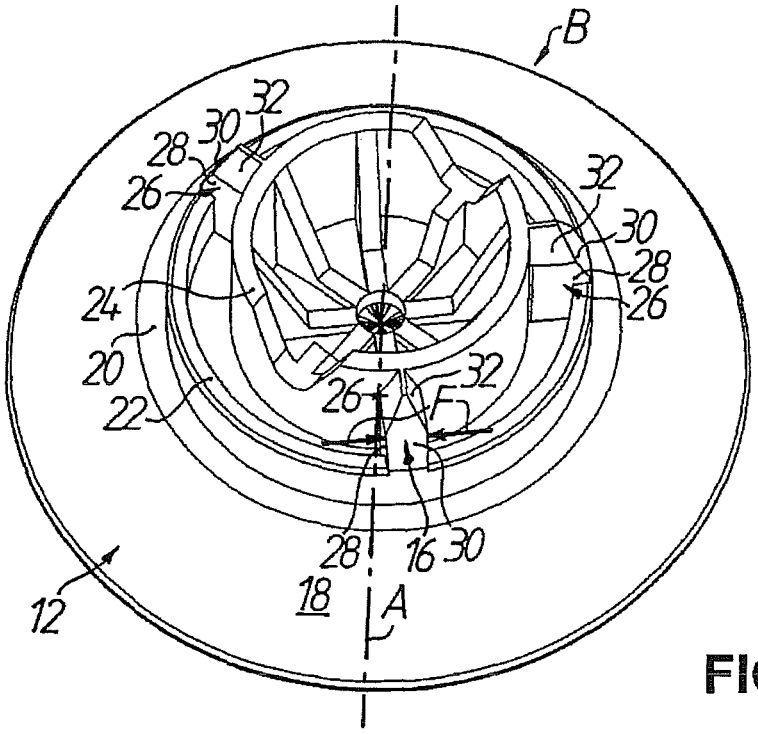
FIG. 25 shows a perspective view of the block piece according to FIG. 24 obliquely from below.

From FIGS. 1 to 12 on the one hand and 13 to 23 on the other hand a first exemplifying embodiment and a second exemplifying embodiment, respectively, of a clamping device 10 and 10', respectively, are evident, which is fastenable in/to a processing machine or coating facility—in FIGS. 4 and 14 a part of a workpiece spindle S of a processing machine is for this purpose indicated by way of example by dashed lines—and to which in addition it is common that they are adapted in a manner, which is to be described in more detail below, for the mounting/clamping of a block piece B (cf. FIGS. 5 and 16), which is shown in more detail in FIGS. 24 and 25 and shall be described in the following only to the extent appearing necessary for an understanding of the disclosed embodiments of the invention; reference may otherwise be specifically made, with respect to the construction/function of the block piece B, to the earlier European Patent Application 08 003 335.0 of the present applicant, which application has, inter aria, this block piece B as its subject.

According to FIGS. 24 and 25 the block piece B has a base body 12 with a workpiece fastening section 14, to which, for example, a spectacle lens blank (not shown) can be fastened by a blocking material (similarly not illustrated) and a clamping section 16 by way of which the block piece B and thus the blocked spectacle lens blank can be held in the clamping device 10, 10'. Starting from the workpiece fastening section 14 of the base body 12, a substantially conical transition surface 18 adjoins at the outer circumferential side and leads to a substantially planar back surface 20 on the rear side of the block piece B. Starting from the back surface 20 of the base body 12 two annular sections 22, 24 of different diameter are arranged concentrically with respect to a center axis A of the base body 12, wherein the radially inner annular section 24 protrudes in axial direction beyond the radially outer annular section 22.

This block piece B has the clamping section 16 of the base body 12 being adapted to be clamped or held by clamping forces which are oriented substantially in a circumferential direction with respect to the center axis A of the base body 12 or substantially in a tangential direction at a spacing with respect to the center axis A of the base body 12. For this purpose the clamping section 16 has at least one clamping projection 26, in the illustrated exemplifying embodiment three clamping projections 26, which extend in radial direction and are non-uniformly distributed over the circumference and which starting from the back surface 20 of the base body 12 bridge over the annular gap between the radially outer annular section 22 and the radially inner annular section 24. Each clamping projection 26 has two mutually remote side surfaces 28, which respectively face in circumferential direction, for application of the above-mentioned clamping forces, which are schematically indicated in FIGS. 24 and 25 for the front clamping projection 26 by arrows F. It is apparent that the clamping forces F at the respective clamping projection 26 are mutually canceling without migrating through the entire base body 12 of the block piece B. Accordingly, there is no excessive deformation/bending of the block piece B and accordingly no distortion/twisting of the workpiece fastening section 14 and the spectacle lens blank, which is blocked thereon, as a consequence of the clamping forces F.

As is further evident from FIGS. 24 and 25, each clamping projection 26 of the block piece B has a radially outer inclined surface 30 which extends at an inclination with respect to the center axis A of the base body 12, wherein the radially outer inclined surfaces 30 together define an outer conical (pre-) centering section of the base body 12, which adjoins the outer circumference of the radially outer annular section 22. Finally, each clamping projection 26 has an axial end section 32, which faces away from the workpiece fastening section 14 and which as seen in radial direction has a V-shaped cross-section in order to form—again for centering purposes in the clamping device 10, 10' —a 'roof-shaped' end.

Figure 5:
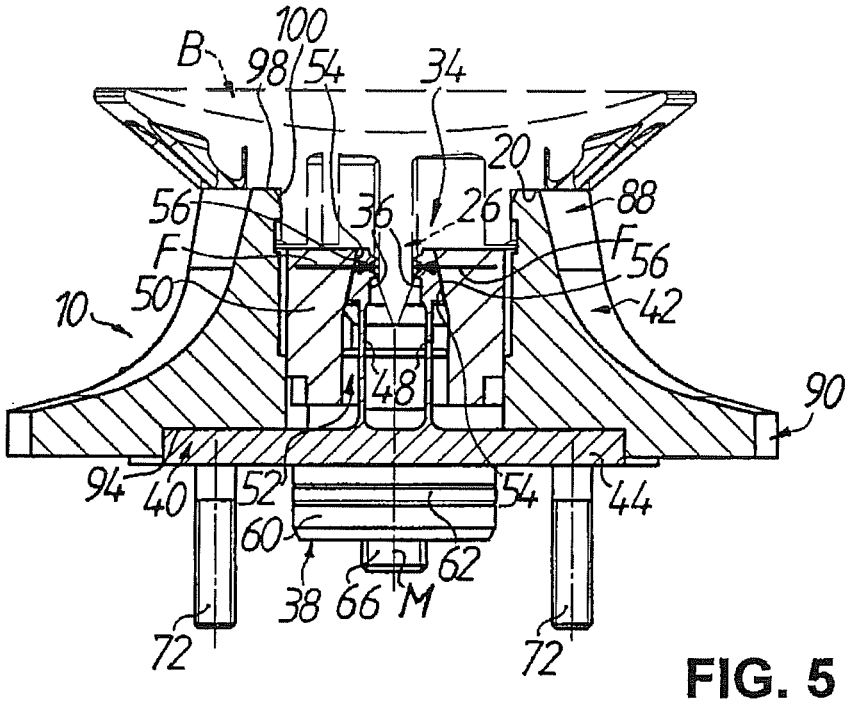
FIG. 5 shows a sectional view of the clamping device according to FIG. 1 in correspondence with the section line V-V in FIG. 3, in which a block piece illustrated by dashed lines is clamped.
Figure 16:
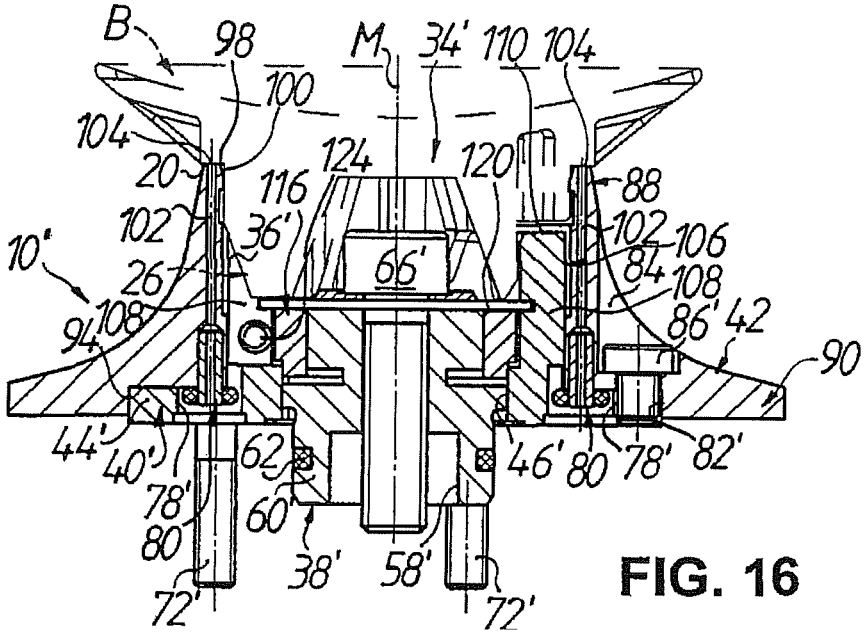
FIG. 16 shows a sectional view of the clamping device according to FIG. 13 in correspondence with the section line XVI-XVI in FIG. 13, in which a block piece illustrated by dashed lines is clamped.

FIGS. 1 to 12 and 13 to 23 now show the clamping device 10, 10', which is specially adapted for mounting and clamping the above-described block piece B, by way of example in two variants or component parts thereof. In both exemplifying embodiments a central receiving space 34, 34', which has a center axis M, for the clamping section 16 of the block piece B is provided, wherein disposed in an edge region of the receiving space 34, 34' are clamping surfaces 36, 36' which can be selectably brought into engagement with the clamping section 16 of the block piece B, more precisely the side surfaces 28 of the clamping projections 26, in order to clamp and hold the block piece B in the clamping device 10, 10' (as indicated in FIGS. 5 and 16).

Figure 6:
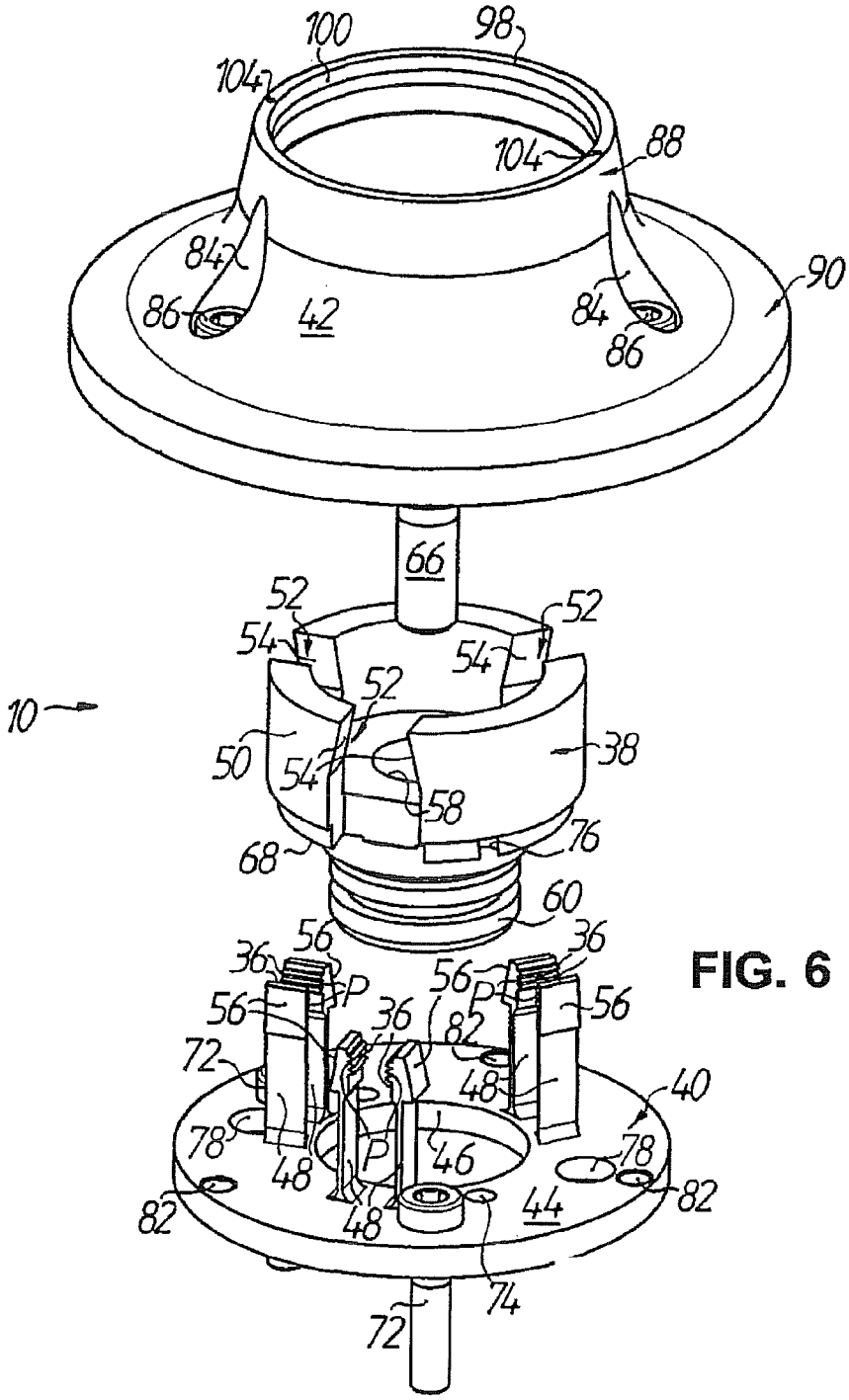
FIG. 6 shows a perspective illustration of the clamping device according to FIG. 1 in exploded arrangement.
Figure 17:
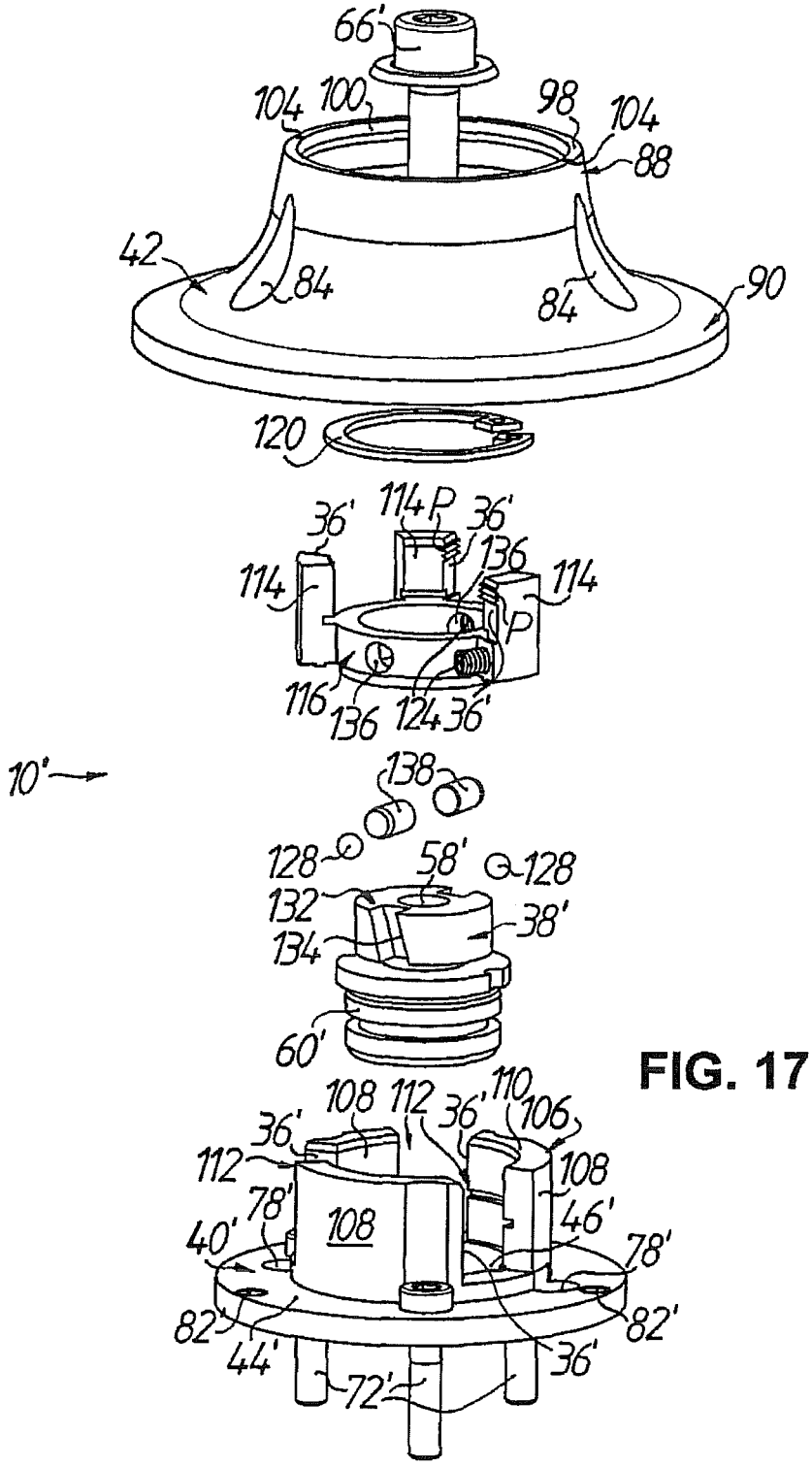
FIG. 17 shows a perspective illustration of the clamping device according to FIG. 13 in exploded arrangement.

These clamping surfaces 36, 36' are arranged and actuable in a particular mode and manner and, specifically, they stand/lie in pairs opposite one another at a radial spacing from the center axis M (as can be readily seen particularly in FIGS. 3 and 13) and are selectably movable towards or away from one another by a clamping member 38, 38' (see, with respect thereto, particularly the exploded illustrations according to FIGS. 6 and 17) in order to either clamp the clamping section 16 of the block piece B, more precisely the clamping projections 26 thereof, against the side surfaces 28 thereof by clamping forces F (indicated by arrows in FIGS. 1 and 5 for the first exemplifying embodiment and one clamping surface pair), which are oriented substantially in a tangential direction at a radial spacing from the center axis M of the receiving space 34, 34' so that they do not run through the entire base body 12 of the block piece B and cannot unacceptably deform this, or release the clamping section 16 of the block piece B and thus the blocked workpiece. Beyond that, in this manner a mechanically positive rotational entrainment of the block piece B can be effected by way of the clamping device 10, 10' without further measures having to be provided for this purpose. In both exemplifying embodiments the clamping member 38, 38' is, for generating the relative movement of the clamping surfaces 36, 36' of each clamping surface pair, axially movable in the direction of the center axis M as will be described in more detail in the following, so that the clamping device 10, 10' can be readily mounted in place of a conventional clamping device, which is usually axially actuated by way of a tension rod, at, for example, a workpiece spindle S of a processing machine.

Figure 12:
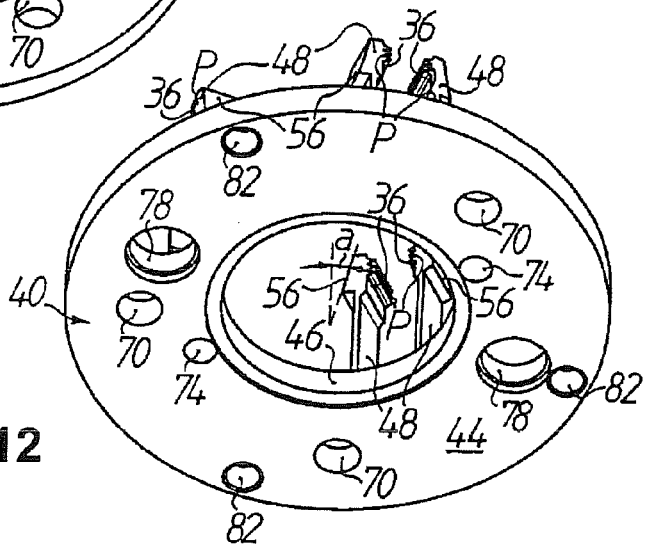
FIG. 12 shows a perspective view of the base of the clamping device according to FIG. 1 obliquely from below.
Figure 13:
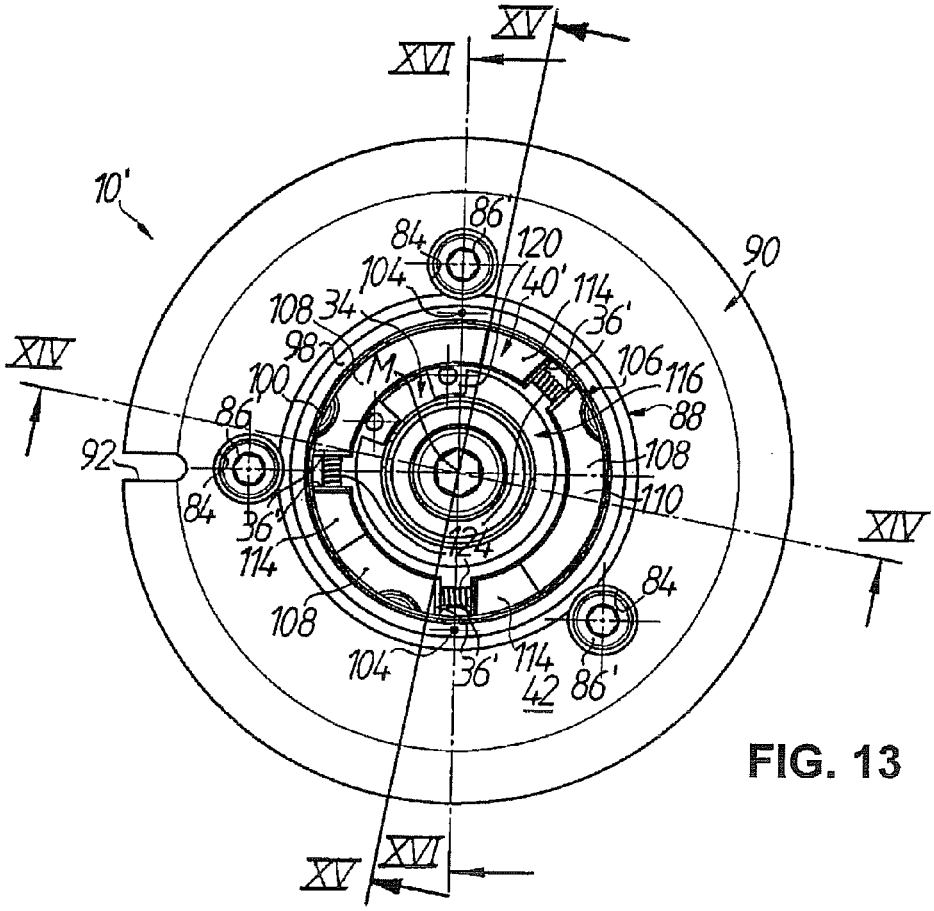
FIG. 13 shows a plan view of a clamping device according a second exemplifying embodiment of the invention, with a substantially four-part construction, comprising an outer sleeve, an annular part, a clamping member and a base as well as diverse small parts (fasteners, seals, etc.)

In addition, in both exemplifying embodiments three pairs of clamping surfaces 36, 36' are provided, which in correspondence with the arrangement of the clamping projections 26 at the block piece B (see, with respect thereto, particularly FIG. 25) are non-uniformly distributed over the circumference of the receiving space 34, 34', for example starting from the upper clamping surface pair in FIG. 3 or starting from the lower clamping surface pair in FIG. 13 and as seen in clockwise sense about the center axis M at an angular spacing of 90°, 135° and again 135° between the successive clamping surface pairs at the circumference of the receiving space 34, 34', so that the block piece B can be clamped only in a predetermined angular setting in the clamping device 10, 10'. Moreover, for better transmission of force to the comparatively soft clamping projections 26 of the block piece B, which here consists of plastics material, in both exemplifying embodiments at least one clamping surface—in the first exemplifying embodiment even both clamping surfaces 36, 36'—of each clamping surface pair is or are provided with a profiling P in the form of, for example, a ribbing, such as is evident from, in particular, FIGS. 6, 11, 12, 17, 18 and 19. Finally, it is common to both exemplifying embodiments that at least one clamping surface—in the first exemplifying embodiment again both clamping surfaces 36, 36'—of each clamping surface pair is or are formed at a base 40, 40', which is stationary with respect to the workpiece spindle S (see FIGS. 4 and 14), of the clamping device 10, 10' and that an outer sleeve 42, which is identical for both exemplifying embodiments and accordingly illustrated as a component part only for the first exemplifying embodiment in FIGS. 7 and 8 and which surrounds the clamping surface pair and protects the mechanism of the clamping device 10, 10', is provided.

Figure 11:
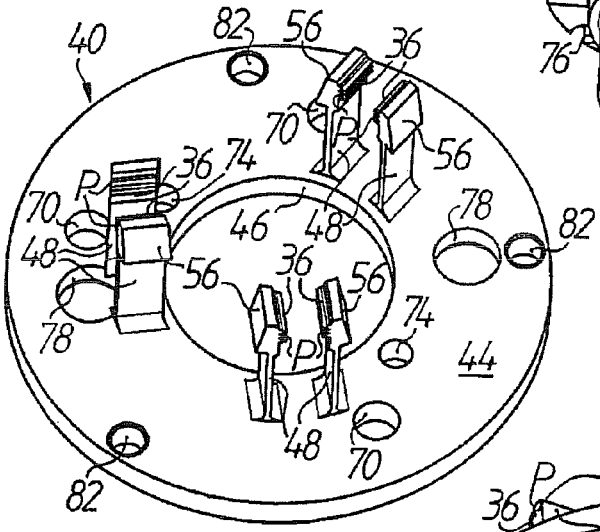
FIG. 11 shows a perspective view of the base of the clamping device according to FIG. 1 obliquely from above.

In the case of the first exemplifying embodiment the metallic base 40 has, particularly according to FIGS. 6, 11 and 12, a disc-shaped flange section 44, from the upper side of which near a central opening 46 extends a plurality of—in the illustrated exemplifying embodiment six—resilient clamping elements 48 substantially at right angles to the flange section 44. The resilient clamping elements 48 are—forming, as such, solid body joints—constructed integrally with the flange section 44 as shown, but alternatively thereto can also be produced separately and fastened in suitable manner, for example by welding or glueing in associated openings, to the flange section 44. The clamping elements 48 are additionally provided in pairs opposite one another at the free end with a respective profiled (profiling P) clamping surface 36 and are disposed in operative connection with the clamping member 38, so that the mutually opposite clamping surfaces 36 of each clamping element pair are movable towards one another under resilient deformation of the clamping elements 48 by relative movement of the clamping member 38 with respect to the base 40.

For this purpose, the clamping member 38 according to, in particular, FIGS. 5, 6, 9 and 10 has a substantially hollow-cylindrical section 50, which is provided with radially continuous cut-outs 52, which subdivide the hollow-cylindrical section 50 into annular segments, each for reception of a respective clamping element pair. Moreover, the clamping member 38 has in the region of each cut-out 52, more specifically at the upper end thereof in FIGS. 5, 6 and 10, mutually opposite inclined surfaces 54, which co-operate with rear inclined surfaces 56, which face away from the clamping surfaces 36, at the clamping elements 48 in order to resiliently deform, or resiliently bend towards one another, the clamping elements 48 of each clamping element pair, when axial relative movement between clamping member 38 and base 40 occurs, under sliding contact of the mutually associated inclined surfaces 54, 56 so that the clamping projection 26, which is received between the clamping surfaces 36 of the respective clamping element pair, of the block piece B is gripped or clamped. In order to introduce the clamping forces into the clamping elements 48 as close as possible to the free end, the substantially planar inclined surfaces 56 at the clamping elements 48 of the base 40 run more flatly with respect to the center axis M than the substantially planar inclined surfaces 54 in the region of the cut-outs 52 of the clamping member 38 (see FIGS. 10 and 12: the angle a between the inclined surfaces 56 at the non-resiliently-deformed clamping elements 48 and a line parallel to the center axis M is smaller than the angle b between the inclined surfaces 54 at the clamping member 38 and a line parallel to the center axis M).

Connected with the hollow-cylindrical section 50 of the clamping member 38 is a pin-shaped projection 60, which is provided with a stepped passage bore 58 and tightly engages through the opening 46 in the flange section 44 of the base 40 according to FIG. 4 and which is also stepped at the outer circumference, which is of smaller diameter by comparison with the outer diameter of the hollow-cylindrical section 50. Below the base 40, the projection 60 is inserted, sealed by an O-ring 62 (shown only in FIGS. 2, 4 and 5), into an associated bore 64 (see FIG. 4) of the workpiece spindle 6 and is there screw-connected with a tension rod (not shown) in the workpiece spindle S by way of a central screw 66, which engages through the passage bore 58. To that extent it is evident that through drawing the clamping member 38 by the tension rod in FIGS. 3 and 4 in downward direction the clamping movement of the clamping elements 48 in the direction of the arrows F in FIG. 5 is produced, wherein if the block piece B is not in place the relative movement between clamping member 38 and base 40 comes to an end by abutment of a lower annular surface 68, which is interrupted by the cut-outs 52, of the hollow-cylindrical section 50 of the clamping member 38 against the upper side of the flange section 44 of the base 40.

As can, moreover, be inferred particularly from FIGS. 6, 11 and 12, the flange section 44 of the base 40 is provided with diverse continuous bores. These are, in detail: three fastening bores 70, which are distributed on a substantially median pitch circle and are traversed by fastening screws 72, which serve the purpose of fixedly fastening the base 40 to the workpiece spindle S (see FIG. 4); two receiving bores 74, which are diametrically opposite with respect to the center axis M, each for a respective cylindrical pin (not illustrated), which engages in a respectively associated receiving bore 76 in the annular surface 68 of the clamping member 38 in order to hold the clamping member 38 to be axially movable, but fixed against rotation, relative to the base 40; two larger diameter passage bores 78, which are again diametrically opposite with respect to the center axis M, each for a respective back-pressure connection (shown at 80 merely for the second exemplifying embodiment in FIG. 16), the sense and purpose of which will be subsequently explained; and finally three threaded bores 82, which lie on an outer pitch circle and into which fastening screws 86, 86'—which pass through stepped passage bores 84 in the outer sleeve 42—are screwed in order to firmly fasten the outer sleeve 42 to the socket 40.

Figure 7:
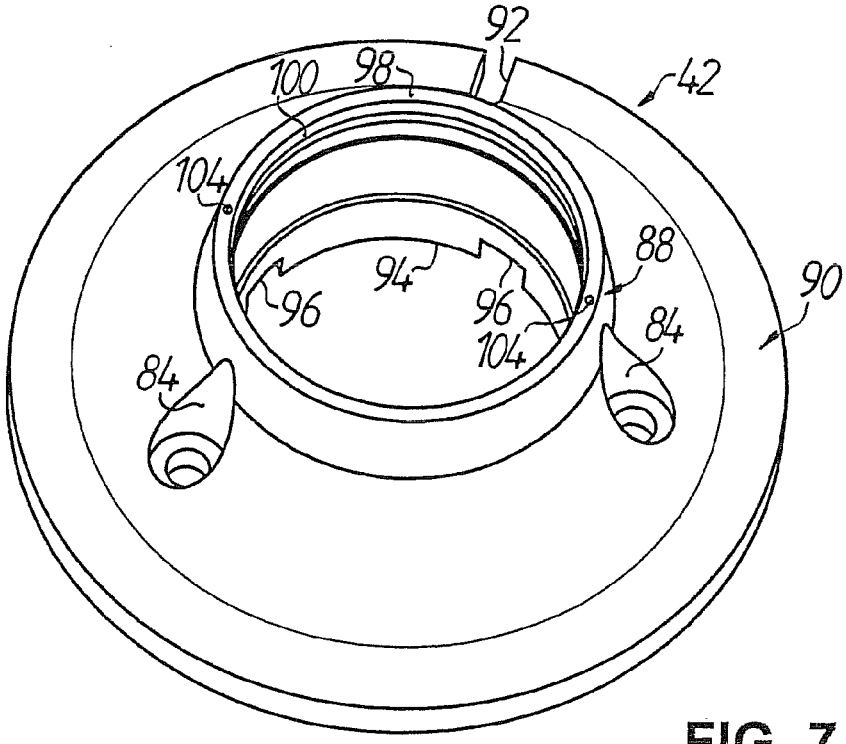
FIG. 7 shows a perspective view of the outer sleeve of the clamping device according to FIG. 1 obliquely from above.
Figure 8:
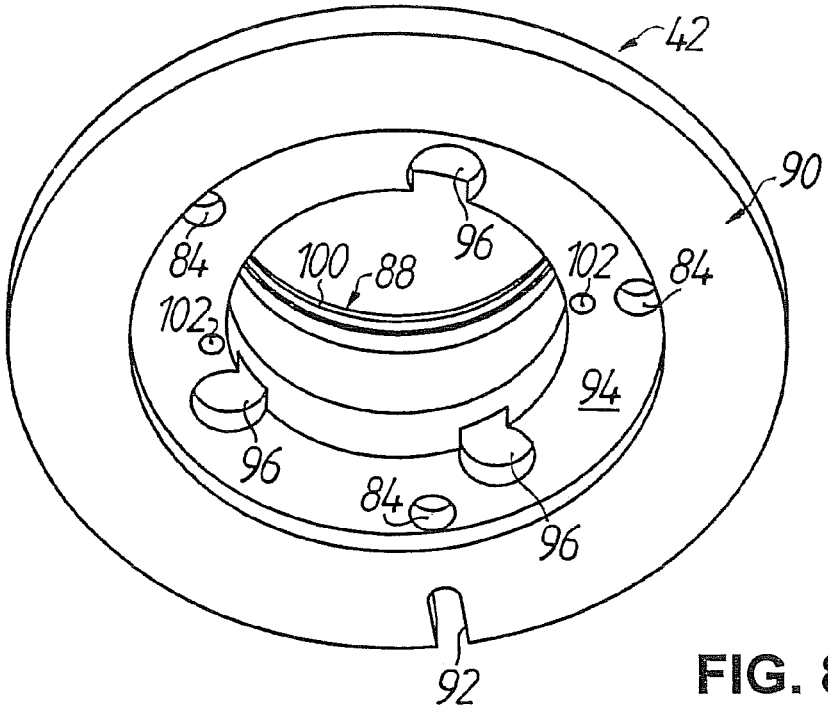
FIG. 8 shows a perspective view of the outer sleeve of the clamping device according to FIG. 1 obliquely from below.
Figure 9:
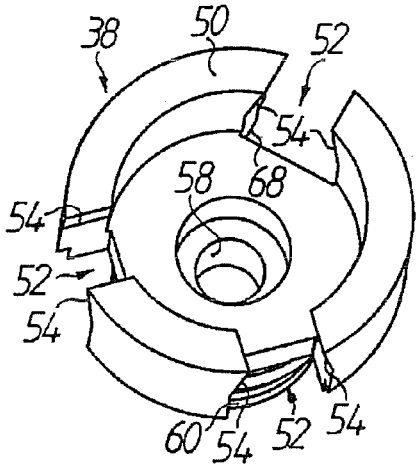
FIG. 9 shows a perspective view of the clamping member of the clamping device according to FIG. 1 obliquely from above.
Figure 10:
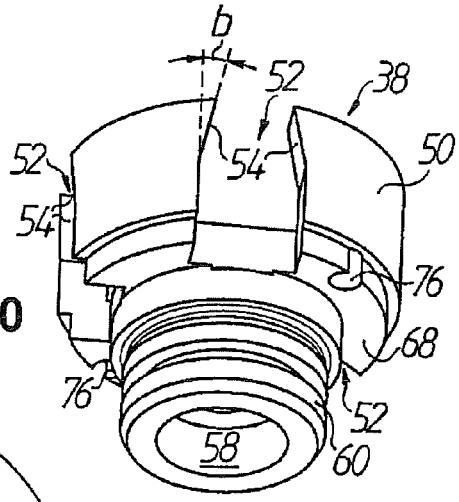
FIG. 10 shows a perspective view of the clamping member of the clamping device according to FIG. 1 obliquely from below.

The metallic outer sleeve 42, which is shown in more detail in FIGS. 7 and 8, of the clamping device 10 has a sleeve section 88 and a flange section 90, which is connected radially outwardly therewith without transition or with radiusing and which is provided radially from the outside with a slot 92 for rotational orientation of the outer sleeve 42 at an indexing pin (not shown) of the workpiece spindle S. Going out from the underside the flange section 90 has a recess 94 for reception of the flange section 44 of the base 40, which in turn is provided the base with recesses 96 receiving the heads of the fastening screws 72.

At the free end of the of the sleeve section 88 the outer sleeve 44 has at the end face a planar annular surface 98 for support of the block piece B. As evident, particularly from FIG. 5 (or 16 for the second exemplifying embodiment), the block piece B when correctly clamped in the clamping device 10 rests by an annular region of its back surface 20, which is disposed radially outside the annular section 22, flatly on the annular surface 98. Connected at the inner circumferential side with the annular surface 98 at the free end of the sleeve section 88 of the outer sleeve 42 is a substantially conically extending centering surface 100 at which the block piece B when inserted into the clamping device 10 is pre-centered by way of the inclined surfaces 30 at the clamping projections 26. The sleeve section 88 of the outer sleeve 42 otherwise protectively surrounds, by its inner circumference, the clamping surfaces 36 and thus also bounds the receiving space 34 radially outwardly.

Finally, it is to be noted with respect to the outer sleeve 42 that at least one back-pressure channel—in the illustrated exemplifying embodiments two back-pressure channels (shown in the second exemplifying embodiment in FIG. 16 by 102) diametrically opposite with respect to the center axis M—extends or extend through the sleeve section 88 substantially parallel to the center axis M, which channel or channels end at the annular surface 98 with a respective opening 104. In order to check the correct seating of the block piece B the back-pressure channels 102 can be loaded with compressed air; if the block piece B rests by its rear surface 20 flatly on the annular surface 98 of the outer sleeve 42—which at the same time means that the clamping projections 26 of the block piece B are disposed between the clamping surfaces 36—the two openings 104 of the back-pressure channels 102 are thus closed and a back-pressure then builds up, which indicates that the block piece B is correctly seated in the clamping device 10. If no back-pressure or only an insufficient back-pressure builds up, a pressure monitor (not shown) responds and gives an alarm.

Figure 1:
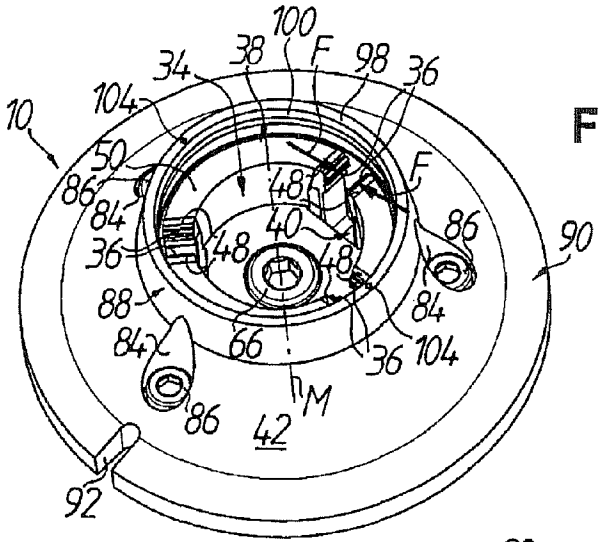
FIG. 1 shows a perspective view of a clamping device according to a first exemplifying embodiment of the invention obliquely from above, with a substantially three-part construction, comprising an outer sleeve, a clamping member and a base as well as diverse small parts (fasteners, seals, etc.)
Figure 2:
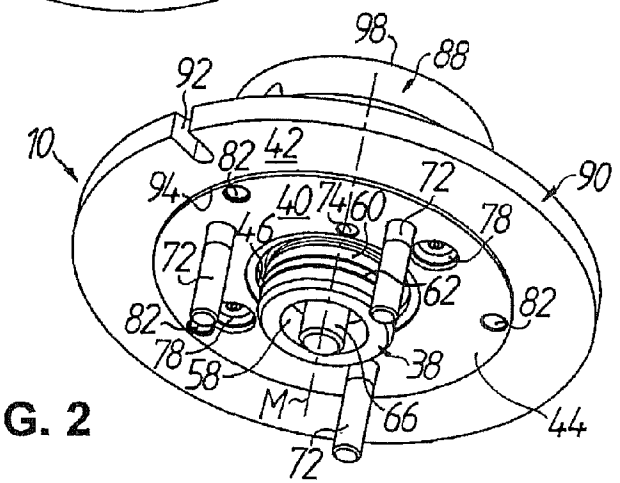
FIG. 2 shows a perspective view of the clamping device according to FIG. 1, obliquely from below.

With respect to the actual clamping process it remains to be noted that the block piece B in the case of optional automated insertion into the clamping device 10 is initially pre-centered on the one hand by co-operation of the radially outer inclined surfaces 30 at the clamping projections 26 with the centering surface 100 at the outer sleeve 42 and on the other hand by co-operation of the roof-shaped end sections 32 of the clamping projections 26 with the terminating edges of the clamping surfaces 36 at the free ends of the clamping elements 48 before the final centering of the block piece B in the receiving space 34 by the clamping movement, which is produced by way of the axial displacement of the clamping member 38, of the clamping elements 48 takes place (in the direction of the arrow F in FIGS. 1 and 5).

The second exemplifying embodiment of the clamping device 10' shall be described in the following with reference to FIGS. 13 to 23 only to the extent that it significantly differs from the first exemplifying embodiment, wherein identical parts are provided with the same reference numerals without a dash, corresponding or functionally similar parts are provided with the same reference numerals with a dash (') and new parts are provided with further reference numerals.

The second exemplifying embodiment differs from the first exemplifying embodiment principally in that the actual clamping mechanism for generating the relative movement, which is necessary for the circumferential or tangential clamping of the block piece B, of the clamping surfaces 36' is formed in a different way. Thus, the base 40' according to, in particular, FIGS. 17, 22 and 23 has at the outset a substantially hollow-cylindrical section 106, which is connected with the flange section 44' and which for formation of several stationary clamping jaws 108, which each have a smooth, i.e. unprofiled, clamping surface 36', is provided going out from its end surface 110 with several—in the illustrated exemplifying embodiment three—cut-outs 112 in which movable clamping jaws 114 each with a respective profiled clamping surface 36' are received so that each clamping surface pair has a clamping surface 36' at a substantially annular segmental stationary clamping jaw 108 and a clamping surface 36' at a substantially annular segmental movable clamping jaw 114.

Figure 18:
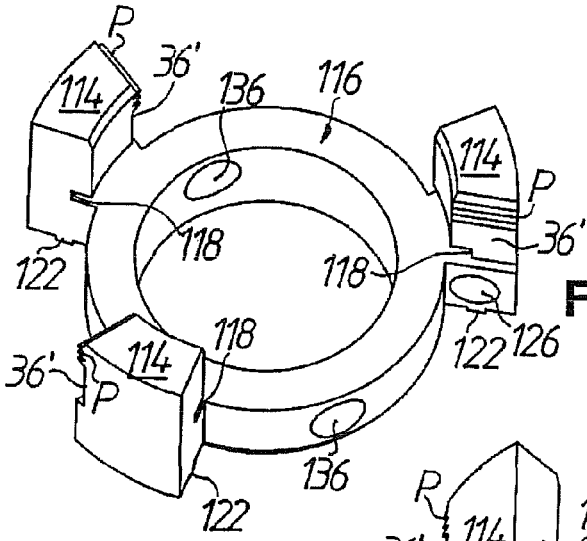
FIG. 18 shows a perspective view of the annular part of the clamping device according to FIG. 13 obliquely from above.
Figure 19:
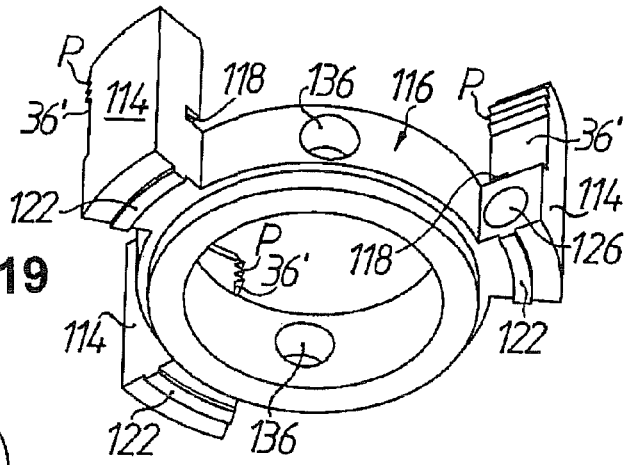
FIG. 19 shows a perspective view of the annular part of the clamping device according to FIG. 13 obliquely from below.
Figure 20:
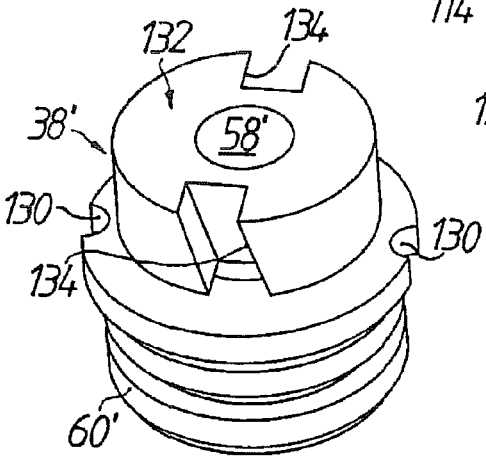
FIG. 20 shows a perspective view of the clamping member of the clamping device according to FIG. 13 obliquely from above.
Figure 21:
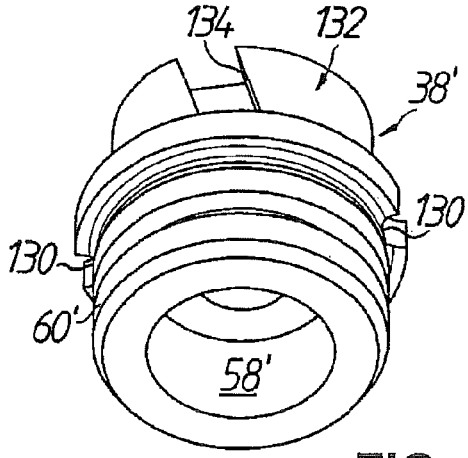
FIG. 21 shows a perspective view of the clamping member of the clamping device according to FIG. 13 obliquely from below.
Figure 22:
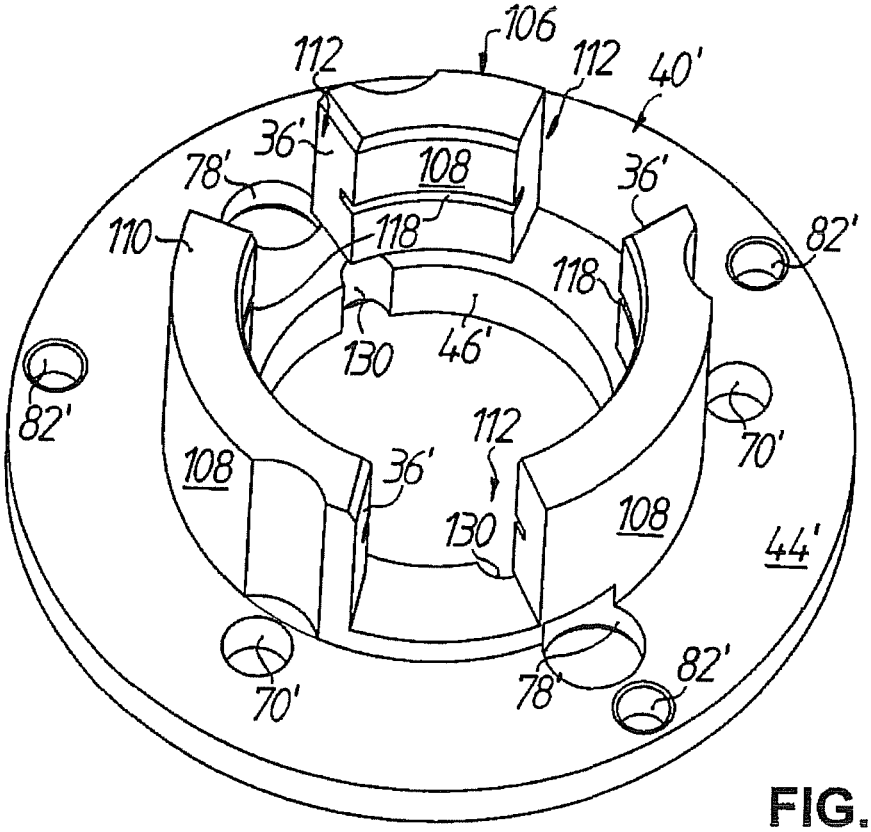
FIG. 22 shows a perspective view of the base of the clamping device according to FIG. 13 obliquely from above.
Figure 23:
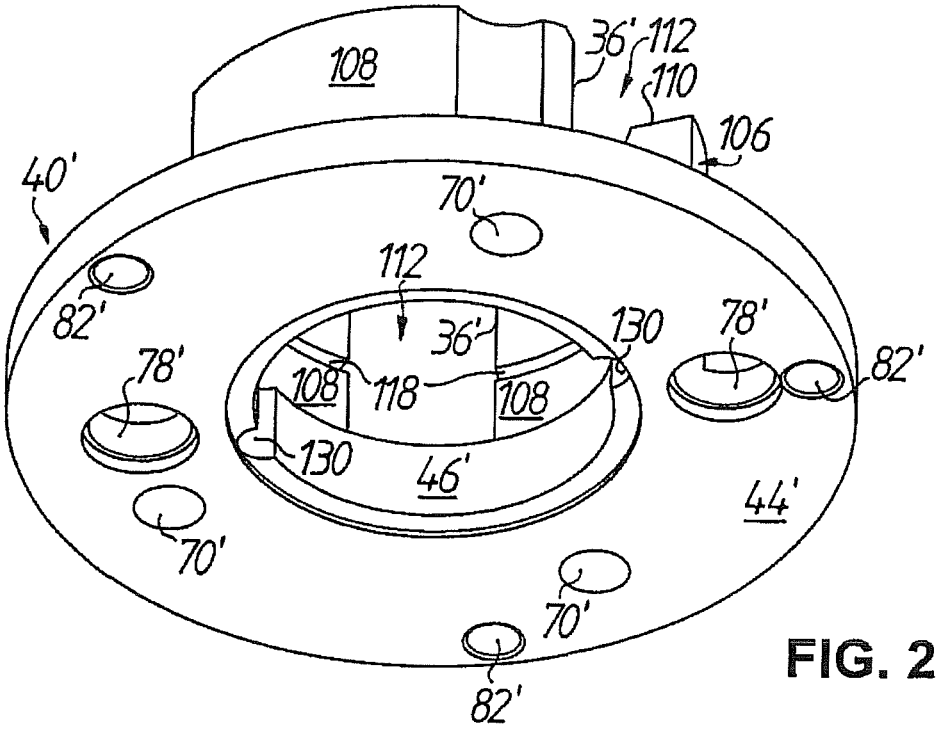
FIG. 23 shows a perspective view of the base of the clamping device according to FIG. 13 obliquely from below.

As is evident particularly from FIGS. 17, 18 and 19, the movable clamping jaws 114 are mounted in crown-like manner on an annular part 116, which is rotatable with respect to the base 40' about the center axis M. In that case, not only the stationary clamping jaws 108 of the base 40', but also the movable clamping jaws 114 of the annular part 116 are provided at the inner circumferential side with radial grooves (indicated merely in FIGS. 18, 19, 22 and 23 by 118) for reception of a securing element 120, which holds together the base 40' and annular part 116. In order to keep the friction of the movable clamping jaws 114 of the annular part 116 in the cut-outs 112 of the base 40' low, the movable clamping jaws 114 according to FIGS. 18 and 19 are each provided on the underside thereof with a respective curved rib 122, which ribs lie in common on a notional circle. It is apparent that the required clamping (relative) movement between the clamping surfaces 36' of each clamping surface pair can be produced by rotation of the annular part 116 about the center axis M with respect to the base 40'. In order to facilitate release of the clamping device 10', each clamping surface pair is urged apart by a compression spring 124, which is arranged between the stationary and movable clamping jaws 108 and 114, respectively, associated with the respective clamping surface pair, for which purpose each movable clamping jaw 114 has, according to FIGS. 18 and 19, a receiving bore 126 for the respective compression spring 124.

In the case of the second exemplifying embodiment the clamping member 38' is operatively connected with the annular part 116 in such a manner that an axial movement of the clamping member 38' in the direction of the center axis M produces a rotational movement of the annular part 116 about the center axis M. For this purpose, the clamping member 38' held to be secure against rotation relative to the base 40'—which is effected by balls 128 (see FIGS. 15 and 17), the balls being inserted in associated axial grooves 130 at the clamping member 38' and base 40' (cf. FIGS. 20, 21, 22 and 23)—has at a head section 132 at least one control surface 134—in the illustrated exemplifying embodiment two control surfaces 134 set at an inclination with respect to the center axis M (see FIGS. 17, 20 and 21)—which is or are formed according to, in particular, FIG. 20 on sides, which are diametrically opposite with respect to the center axis M, of the clamping member 38' by grooves in the head section 132 thereof. A clamping pin 138 connected with the annular part 116, more precisely inserted in an associated radial bore 136 in the annular part 116, engages each control surface 134 (see, with respect thereto, particularly FIG. 14) in order to produce the rotational movement of the annular part 116 in clockwise sense in FIG. 13 when axial movement of the clamping member 38' downwardly in FIGS. 14 to 16 occurs.

A device for clamping, in particular, a spectacle lens, which is blocked on a block piece, for processing and/or coating thereof is disclosed, which device comprises a receiving space, which has a center axis, for a clamping section of the block piece and a plurality of clamping surfaces, which are provided in an edge region of the receiving space and which can be selectably brought into engagement with the clamping section of the block piece in order to clamp the block piece. In order to avoid excessive deformation of the clamped block piece the clamping surfaces are disposed in pairs opposite one another at a radial spacing from the center axis and are selectably movable towards or away from another by a clamping member in order to clamp the clamping section of the block piece by clamping forces, which are oriented substantially in a tangential direction at a radial spacing from the center axis, or in order to release the block piece.

Variations and modifications are possible without departing from the scope and spirit of the present invention as defined by the appended claims.

We claim:

1. A clamping device (10, 10') for clamping a workpiece, particularly spectacle lens, blocked on a block piece (B) for processing and/or coating the workpiece, comprising a receiving space (34, 34'), which has a center axis (M), for a clamping section (16) of the block piece (B) and a plurality of clamping surfaces (36, 36'), which are provided in an edge region of the receiving space (34, 34') and which can be selectably brought into engagement with the clamping section (16) of the block piece (B) in order to clamp the block piece (B), characterized in that the clamping surfaces (36, 36') are disposed opposite one another in pairs at a radial spacing from the center axis (M) with the clamping surfaces of each pair facing each other and being selectably movable towards one another by a clamping member (38, 38') in order to clamp the clamping section (16) of the block piece (B) by clamping forces (F), which are oriented substantially in a circumferential direction with respect to the center axis (M) or substantially in a tangential direction at a radial spacing from the center axis (M), or movable away from one another in order to release the clamping section (16) of the block piece (B).

2. A clamping device (10, 10') according to claim 1, characterized in that three pairs of clamping surfaces (36, 36') distributed over the circumference of the receiving space (34, 34') are provided.

3. A clamping device (10, 10') according to claim 1, characterized in that the clamping surface pairs are distributed non-uniformly over the circumference of the receiving space (34, 34').

4. A clamping device (10, 10') according to claim 1, characterized in that at least one clamping surface (36, 36') of each clamping surface pair is provided with a profiling (P).

5. A clamping device (10, 10') according to claim 1, characterized in that the clamping member (38, 38') is axially movable in the direction of the center axis (M) for producing the relative movement of the clamping surfaces (36, 36') of each clamping surface pair.

6. A clamping device (10, 10') according to claim 1, characterized in that at least one clamping surface (36, 36') of each clamping surface pair is formed at a preferably stationary base (40, 40') of the clamping device (10, 10').

7. A clamping device (10) according to claim 6, characterized in that the base (40) comprises a plurality of resilient clamping elements (48), which are provided in pairs oppositely to one another at the free end with a respective clamping surface (36) and are disposed in operative connection with the clamping member (38) so that the mutually opposite clamping surfaces (36) of each clamping element pair are movable towards one another under resilient deformation of the clamping elements (48) by relative movement of the clamping member (38) with respect to the base (40).

8. A clamping device (10) according to claim 7, characterized in that the clamping member (38) has a substantially hollow-cylindrical section (50) which is provided with cut-outs (52) each for reception of a respective clamping element pair, wherein the clamping member (38) has in the region of each cut-out (52) mutually opposite inclined surfaces (54) which co-operate with inclined surfaces (56), which are remote from the clamping surfaces (36) and at the rear side, at the clamping elements (48) in order to resiliently deform the latter when axial relative movement between the clamping member (38) and base (40) occurs.

9. A clamping device (10) according to claim 8, characterized in that the substantially planar inclined surfaces (56) at the clamping elements (48) of the base (40) extend more flatly with respect to the center axis (M) than the substantially planar inclined surfaces (54) in the region of the cut-outs (52) of the clamping member (38).

10. A clamping device (10') according to claim 1, characterized in that the base (40') has a substantially hollow-cylindrical section (106) which for formation of a plurality of stationary clamping jaws (108) each having a respective clamping surface (36') is provided starting from an end face (110) with a plurality of cut-outs (112) in which movable clamping jaws (114) each with a respective clamping surface (36') are received so that each clamping surface pair has a clamping surface (36') at a stationary clamping jaw (108) and a clamping surface (36') at a movable clamping jaw (114).

11. A clamping device (10') according to claim 10, characterized in that the movable clamping jaws (114) are mounted in crown-like manner on an annular part (116), which is rotatable with respect to the base (40') about the center axis (M).

12. A clamping device (10') according to claim 11, characterized in that the clamping member (38') is operatively connected with the annular part (116) so that an axial movement of the clamping member (38') in the direction of the center axis (M) produces a rotational movement of the annular part (116) about the center axis (M).

13. A clamping device (10') according to claim 12, characterized in that the clamping member (38') held to be secure against rotation relative to the base (40') has at least one control surface (134), which is set at an inclination with respect to the center axis (M) and at which a clamping pin (138), which is connected with the annular part (116), engages in order to produce the rotational movement of the annular part (116) when axial movement of the clamping member (38') occurs.

14. A clamping device (10, 10') according to claim 13, characterized in that the control surfaces (134) set at an inclination with respect to the center axis (M) are formed on sides of the clamping member (38'), which are diametrically opposite with respect to the center axis (M), and co-operate with associated clamping pins (138) at the annular part (116).

15. A clamping device (10') according to claim 10, characterized in that preferably each clamping surface pair is urged apart by a compression spring (124) which is arranged between the stationary and movable clamping jaws (108, 114) associated with the respective clamping surface pair.

16. A clamping device (10, 10') according to claim 1, characterized by an outer sleeve (42) surrounding the clamping surface pair.

17. A clamping device (10, 10') according to claim 16, characterized in that the outer sleeve (42) has at its free end a substantially conically extending centering surface (100) at the inner circumferential side.

18. A clamping device (10, 10') according to claim 17, characterized in that the outer sleeve (42) has at its free end a planar annular surface (98) at the end face for support of the block piece (B).

19. A clamping device (10, 10') according to claim 18, characterized in that at least one back-pressure channel (102) ending at an opening (104) at the annular surface (98) extends through the outer sleeve (42).

20. A clamping device (10') according to claim 5, characterized in that the clamping member (38') is operatively connected with the annular part (116) so that an axial movement of the clamping member (38') in the direction of the center axis (M) produces a rotational movement of the annular part (116) about the center axis (M).

21. A clamping device (10') according to claim 20, characterized in that the clamping member (38') held to be secure against rotation relative to the base (40') has at least one control surface (134), which is set at an inclination with respect to the center axis (M) and at which a clamping pin (138), which is connected with the annular part (116), engages in order to produce the rotational movement of the annular part (116) when axial movement of the clamping member (38') occurs.

22. A clamping device (10, 10') according to claim 16, characterized in that the outer sleeve (42) has at its free end a planar annular surface (98) at the end face for support of the block piece (B).

23. A clamping device (10, 10') according to claim 22, characterized in that at least one back-pressure channel (102) ending at an opening (104) at the annular surface (98) extends through the outer sleeve (42).

* * * * *